United States Patent [19]

Ritt et al.

[11] Patent Number: 4,917,978

[45] Date of Patent: Apr. 17, 1990

[54] METHOD OF ELECTROPHOTOGRAPHICALLY MANUFACTURING A LUMINESCENT SCREEN ASSEMBLY HAVING INCREASED ADHERENCE FOR A CRT

[75] Inventors: Peter M. Ritt, West Lampeter Township, Lancaster County; Harry R. Stork, Adamstown Borough, both of Pa.

[73] Assignee: Thomson Consumer Electronics, Inc., Indianapolis, Ind.

[21] Appl. No.: 299,507

[22] Filed: Jan. 23, 1989

[51] Int. Cl.[4] ..... G03C 5/00; B05D 3/10; B05D 5/06

[52] U.S. Cl. ..... 430/23; 430/28; 430/29; 427/68; 427/335

[58] Field of Search ..... 430/23, 28, 29; 427/68, 427/335

[56] References Cited

U.S. PATENT DOCUMENTS

| | | | |
|---|---|---|---|
| 2,538,562 | 1/1951 | Gustin et al. | 117/33.5 |
| 2,625,734 | 1/1953 | Law | 29/25.13 |
| 2,682,478 | 6/1954 | House | 430/23 |
| 2,776,907 | 1/1957 | Carlson | 430/124 |
| 2,965,482 | 12/1960 | Dessauer et al. | 430/124 |
| 2,995,464 | 8/1961 | Gundlach | 430/124 |
| 3,475,169 | 10/1969 | Lange | 430/42 |
| 3,489,556 | 1/1970 | Drozd | 430/42 |
| 3,489,557 | 1/1970 | Lange et al. | 430/42 |
| 4,263,386 | 4/1981 | Datta | 430/25 |
| 4,448,866 | 5/1984 | Olieslagers et al. | 430/24 |
| 4,612,268 | 9/1986 | Miura et al. | 430/28 |
| 4,620,133 | 10/1986 | Morrell et al. | 325/15 |
| 4,651,053 | 3/1987 | Kato et al. | 313/466 |
| 4,657,961 | 4/1987 | Nishizawa et al. | 524/297 |

*Primary Examiner*—Paul R. Michl
*Assistant Examiner*—Jeffrey A. Lindeman
*Attorney, Agent, or Firm*—E. M. Whitacre; D. H. Irlbeck; V. J. Coughlin, Jr.

[57] ABSTRACT

The method of electrophotographically manufacturing a luminescent screen assembly on a substrate of a CRT, according to the present invention, includes the steps of coating the substrate with a conductive layer and overcoating the conductive layer with a photoconductive layer, establishing an electrostatic charge on the photoconductive layer, and exposing selected areas of the photoconductive layer to visible light to affect the charge thereon. Then, the selected areas of the photoconductive layer are developed with triboelectrically charged, dry-powdered, surface-treated screen structure materials. The improved process increases the adherence of the surface-treated materials to the photoconductive layer by contacting the surface-treated materials with a solvent to render the photoconductive layer and the materials tacky. The dried screen is fixed with a plurality of coatings of an aqueous alcohol mixture of dichromated polyvinyl alcohol or potassium silicate and then filmed, aluminized and baked to form the screen assembly.

11 Claims, 3 Drawing Sheets

38
40
25
EXPOSE
34
32
18

Phosphors or Black Matrix
DEVELOP
18
32
34
42
D.C. Volts
DEPOSIT
36
CHARGE
FUSE
FIX
44
46
48

Electrophotographic Dry Screening Process

METHOD OF ELECTROPHOTOGRAPHICALLY MANUFACTURING A LUMINESCENT SCREEN ASSEMBLY HAVING INCREASED ADHERENCE FOR A CRT

The present invention relates to a method of electrophotographically manufacturing a screen assembly, and more particularly to manufacturing a screen assembly having increased adherence for a color cathode-ray tube (CRT) using triboelectrically charged, dry-powdered surface-treated screen structure materials.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multiapertured sheet of metal precisely disposed between the screen and the beam-producing means. The apertured metal sheet shadows the screen, and the differences in convergence angles permit the transmitted portions of each beam to selectively excite phosphor elements of the desired emission color. A matrix of light-absorptive material surrounds the phosphor elements.

In one prior process for forming each array of phosphor elements on a viewing faceplate of the CRT, the inner surface of the faceplate is coated with a slurry of a photosensitive binder and phosphor particles adapted to emit light of one of the three emission colors. The slurry is dried to form a coating, and a light field is projected, from a source, through the apertures in the shadow mask and onto the dried coating, so that the shadow mask functions as a photographic master. The exposed coating is subsequently developed to produce the first color-emitting phosphor elements. The process is repeated for the second and third color-emitting phosphor elements, utilizing the same shadow mask, but repositioning the light source for each exposure. Each position of the light source approximates the convergence angle of one of the electron beams which excites the respective color-emitting phosphor elements. A more complete description of this process, known as the photolithographic wet process, can be found in U.S. Pat. No. 2,625,734, issued to H. B. Law on Jan. 20, 1953.

A drawback of the above-described wet process is that the process may not be capable of meeting the higher resolution demands of the next generation of entertainment devices and the even higher resolution requirements for monitors, work stations and applications requiring color alpha-numeric text. Additionally, the wet photolithographic process (including matrix processing) requires 182 major processing steps, necessitates extensive plumbing and the use of clean water, requires phosphor salvage and reclamation, and utilizes large quantities of electrical energy for exposing and drying the phosphor materials.

U.S. Pat. No. 3,475,169, issued to H. G. Lange on Oct. 28, 1969, discloses a process for electrophotographically screening color cathode-ray tubes. The inner surface of the faceplate of the CRT is coated with a volatilizable conductive material and then overcoated with a layer of volatilizable photoconductive material. The photoconductive layer is then uniformly charged, selectively exposed with light through the shadow mask to establish a latent charge image, and developed using a high molecular weight carrier liquid. The carrier liquid bears, in suspension, a quantity of phosphor particles of a given emissive color that are selectively deposited onto suitably charged areas of the photoconductive layer, to develop the latent image. The charging, exposing and deposition process is repeated for each of the three color-emissive phosphors, i.e., green, blue, and red, of the screen. An improvement in electrophotographic screening is described in U.S. Pat. No. 4,448,866, issued to H. G. Olieslagers et al. on May 15, 1984. In that patent, phosphor particle adhesion is said to be increased by uniformly exposing, with light, the portions of the photoconductive layer lying between the deposited pattern of phosphor particles after each deposition step, so as to reduce or discharge any residual charge and to permit a more uniform recharging of the photoconductor for subsequent depositions. Because the latter two patents disclose an electrophotoqraphic process that is, in essence, a wet process, many of the drawbacks described above, with respect to the wet photolithographic process of U.S. Pat. No. 2,625,734 also are applicable to the wet electrophotographic process.

Copending patent applications entitled, METHOD OF ELECTROPHOTOGRAPHICALLY MANUFACTURING A LUMINESCENT SCREEN ASSEMBLY FOR A CATHODE-RAY TUBE, SURFACE TREATMENT 0F PHOSPHOR PARTICLES AND METHOD FOR A CRT SCREEN, and SURFACE TREATMENT OF SILICA COATED PHOSPHOR PARTICLES AND METHOD FOR A CRT SCREEN, by P. Datta et al., filed on Dec. 21, 1988, respectively describe an improved process for manufacturing CRT screen assemblies using triboelectrically charged dry-powdered screen structure materials, and surface-treated phosphor particles having a coupling agent thereon to control the triboelectric charging characteristics of the phosphor particles. During the manufacturing process, the surface-treated screen structure materials are electrostatically attracted to the photoconductive layer on the faceplate, and the attractive force is a function of the magnitude of the triboelectric charge on the screen structure materials. Thermal bonding has been utilized to affix the surface-treated materials to the photoconductive layer; however, thermal bonding occasionally causes cracks in the photoconductive layer, which becomes detached during a subsequent filming step in the manufacturing process. An alternative method to thermal bonding is thus desirable to prevent the loss of screen assemblies during the manufacturing process.

SUMMARY OF THE INVENTION

In accordance with the present invention, a method of electrophotographically manufacturing a luminescent screen assembly on a substrate of a CRT includes the steps of coating the substrate with a conductive layer and overcoating the conductive layer with a photoconductive layer, establishing an electrostatic charge on the photoconductive layer, and exposing selected areas of the photoconductive layer to visible light to affect the charge thereon. Then the selected areas of the photoconductive layer are developed with triboelectrically charged, dry-powdered, surface-treated materials. The improved process increases the adherence of the surface-treated materials to the photoconductive layer by contacting the surface-treated materials and the underlying photoconductive layer with a solvent to render the materials and the layer tacky, and then fixing the materials so as to minimize displacement thereof.

Figure 1:
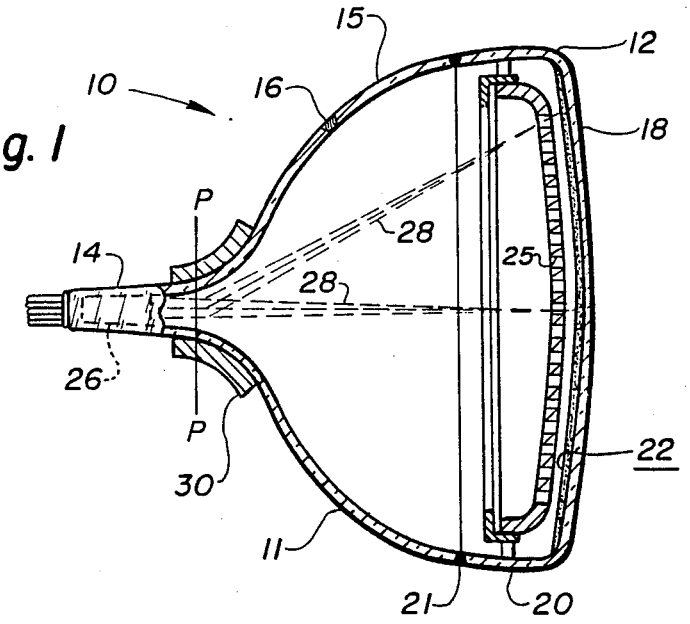
FIG. 1 is a plan view, partially in axial section, of a color cathode-ray tube made according to the present invention.

FIGS. *3a–3f* show selected steps in the manufacturing of the tube shown in FIG. 1.

Figure 4:
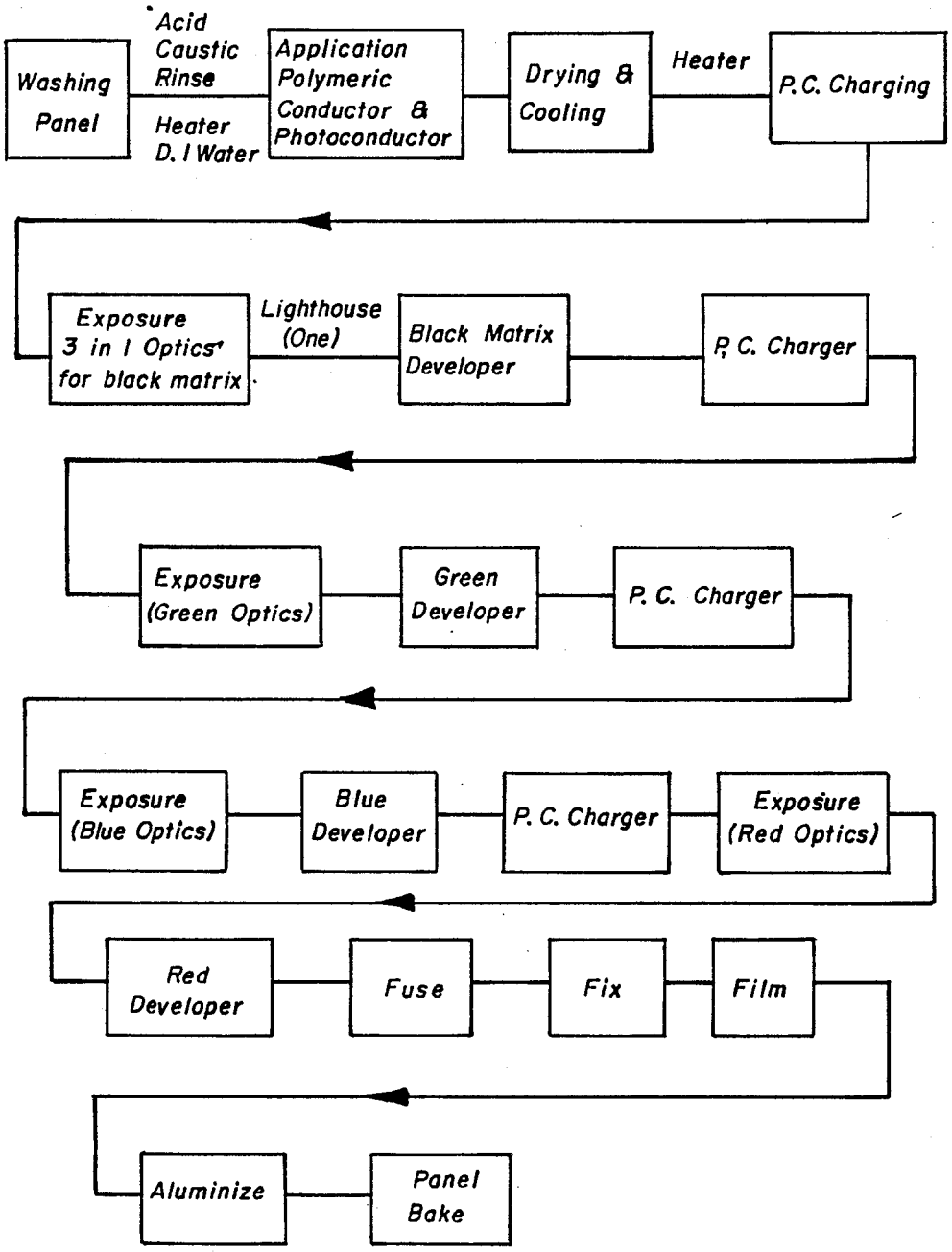

FIG. 4 is a block diagram of the present electrophotographic dry-screening process.

DETAILED DESCRIPTION OF THE PREFERRED EMBODIMENTS

Figure 2:
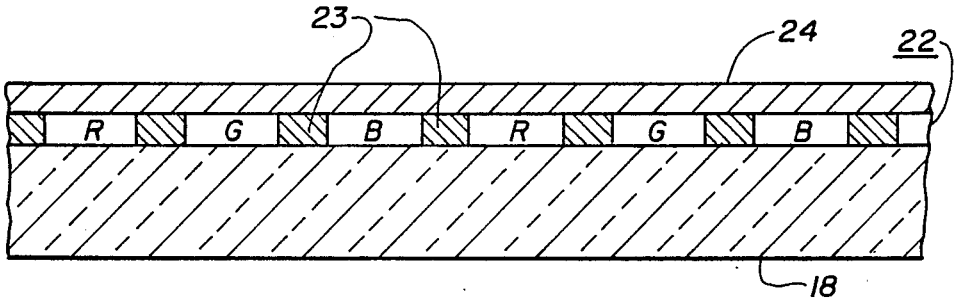
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position for this embodiment, the phosphor stripes extend in the vertical direction, preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen as well as reflecting light, emitted from the phosphor elements, through the faceplate 18. The screen 22 and the overlying aluminum layer 24 comprise a screen assembly.

With respect again to FIG. 1, a multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures in the mask 25, to the screen 22. The gun 26 may be, for example, a bi-potential electron gun of the type described in U.S. pat. No. 4,620,133, issued to Morrell et al. on Oct. 28, 1986, or any other suitable gun.

The tube 10 is designed to be used with an external magnetic deflection yoke, such as yoke 30 located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvatures of the deflection beam paths in the deflection zone are not shown.

The screen 22 is manufactured by a novel electrophotographic process that is schematically represented in FIGS. *3a* through *3f*. Initially, the panel 12 is washed with a caustic solution, rinsed with water, etched with buffered hydrofluoric acid and rinsed once again with water, as is known in the art. The inner surface of the viewing faceplate 18 is then coated with a layer 32 of an electrically conductive material which provides an electrode for an overlying photoconductive layer 34. The conductive layer 32 is coated with the photoconductive layer 34 comprising a volatilizable organic polymeric material, a suitable photoconductive dye sensitive to visible light and a solvent. The composition and method of forming the conductive layer 32 and the photoconductive layer 34 are described in the former above-identified copending patent application.

The photoconductive layer 34 overlying the conductive layer 32 is charged in a dark environment by a conventional positive corona discharge apparatus 36, schematically shown in FIG. *3b*, which moves across the layer 34 and charges it within the range of +200 to +700 volts, +200 to +400 volts being preferred. The shadow mask 25 is inserted in the panel 12, and the positively-charged photoconductor is exposed, through the shadow mask, to the light from a xenon flash lamp 38 disposed within a conventional three-in-one lighthouse (represented by lens 40 of FIG. *3c*). After each exposure, the lamp is moved to a different position, to duplicate the incident angle of the electron beams from the electron gun. Three exposures are required. (rom three different lamp positions to discharge the areas of the photoconductor where the light-emitting phosphors subsequently will be deposited to form the screen. After the exposure step, the shadow mask 25 is removed from the panel 12, and the panel is moved to a first developer 42 (FIG. *3d*). The first developer contains suitably prepared dry-powdered particles of a light-absorptive black matrix screen structure material, and surface-treated insulative carrier beads (not shown) which have a diameter of about 100 to 300 microns and which impart a triboelectrical charge to the particles of black matrix material, as described herein. The carrier beads are surface-treated as described in a copending patent application entitled, METHOD OF SURFACE TREATMENT OF CARRIER BEADS FOR USE IN ELECTROPHOTOGRAPHIC SCREEN PROCESSING, by P. Datta et al. filed on Dec. 21, 1988.

Suitable black matrix materials generally contain black pigments which are stable at a tube processing temperature of 450° C. Black pigments suitable for use making matrix materials include: iron manganese oxide, iron cobalt oxide, zinc iron sulfide and insulating carbon black. The black matrix material is prepared by melt-blending the pigment, a polymer and a suitable charge control agent which controls the magnitude of the triboelectric charge imparted to the matrix material. The material is ground to an average particle size of about 5 microns.

The black matrix material and the surface-treated carrier beads are mixed in the developer 42, using about 1 to 2 percent by weight of black matrix material. The materials are mixed so that the finely divided matrix particles contact and are charged, e.g., negatively, by the surface-treated carrier beads. The negatively-charged matrix particles are expelled from the developer 42 and attracted to the positively-charged, unexposed area of the photoconductive layer 34 to directly develop that area.

The photoconductive layer 34, containing the matrix 23, is uniformly recharged to a positive potential of about 200 to 400 volts, for the application of the first of three triboelectrically charged, dry-powdered, surface-treated, color-emitting phosphor screen structure materials, which are manufactured by the processes described in the above-identified patent applications relating to the surface treatment of phosphor particles. The shadow mask 25 is reinserted into the panel 12, and selected areas of the photoconductive layer 34, corresponding to the locations where green-emitting phosphor material will be deposited, are exposed to visible light from a first location within the lighthouse to selectively discharge the exposed areas. The first light location approximates the convergence angle of the green phosphor-impinging electron beam. The shadow mask 25 is removed from the panel 12, and the panel is moved to a second developer 42. The second developer contains triboelectrically charged, dry-powdered, surface-treated particles of green-emitting phosphor screen structure material, and surface-treated carrier beads. The phosphor particles are surface-treated with a suitable polymeric charge controlling material such as, e.g., polyamide, poly(ethyloxazoline) or gelatin. One thousand grams of surface-treated carrier beads are combined with 15 to 25 grams of surface-treated phosphor particles in the second developer 42. The carrier beads are treated with a fluorosilane coupling agent to impart a, e.g. positive, charge on the phosphor particles. To charge the phosphor particles negatively, an aminosilane coupling agent is used on the carrier beads. The positively-charged green-emitting phosphor particles are expelled from the developer, repelled by the positively-charged areas of the photoconductive layer 34 and matrix 23, and deposited onto the discharged, light exposed areas of the photoconductive layer, in a process known as reversal developing.

The process of charging, exposing and developing is repeated for the dry-powdered, blue- and red-emitting, surface-treated phosphor particles of screen structure material. The exposure to visible light, to selectively discharge the positively-charged areas of the photoconductive layer 34, is made from a second and then from a third position within the lighthouse, to approximate the convergence angles of the blue phosphor- and red phosphor-impinginq electron beams, respectively. The triboelectrically positively-charged, dry-powdered phosphor particles are mixed with the surface-treated carrier beads in the ratio described above and expelled from a third and then a fourth developer 42, repelled by the positively-charged areas of the previously deposited screen structure materials, and deposited on the discharged areas of the photoconductive layer 34, to provide the blue, and red-emitting phosphor elements, respectively.

The dry-powdered phosphor particles are surface-treated by coating the particles with a suitable polymer. The polymers and the process of surface-treating the phosphors are described in the above-mentioned copending patent applications entitled, SURFACE TREATMENT OF PHOSPHOR PARTICLES AND METHOD FOR A CRT SCREEN, and SURFACE TREATMENT OF SILICA COATED PHOSPHOR PARTICLES AND METHOD FOR A CRT SCREEN, by P. Datta et al. which are incorporated by reference herein for the purpose of disclosure. In the former copending application, the coating mixture is formed by dissolving about 0.5 to 5.0 and preferably about 1.0 to 2.0 weight percent of the polymer in a suitable solvent to form a coating mixture. The coating mixture may be applied to the phosphor particles by using either a rotary evaporator and fluidized dryer, an adsorptive method or a spray dryer. The coated particles are dried, deaggregated, if necessary, sieved through a 400 mesh screen and dry milled, if required, with a flow-modifier, such as a silica material sold under the trademark Cabosil (available from the Cabot Corporation, Tuscola, Ill.) or its equivalent. The concentration of flow-modifier ranges from about 0.1 to 2.0 weight percent of the surface-treated phosphor.

In the latter copending patent application, the phosphor particles are first provided with a continuous silicon dioxide (silica) coating, and then overcoated with a silane or titanate coupling agent, formed by dissolving about 0.1 grams of the coupling agent in about 200 ml of a suitable solvent.

Figures 3A, 3B, 3C, 3D, 3E, 3F:
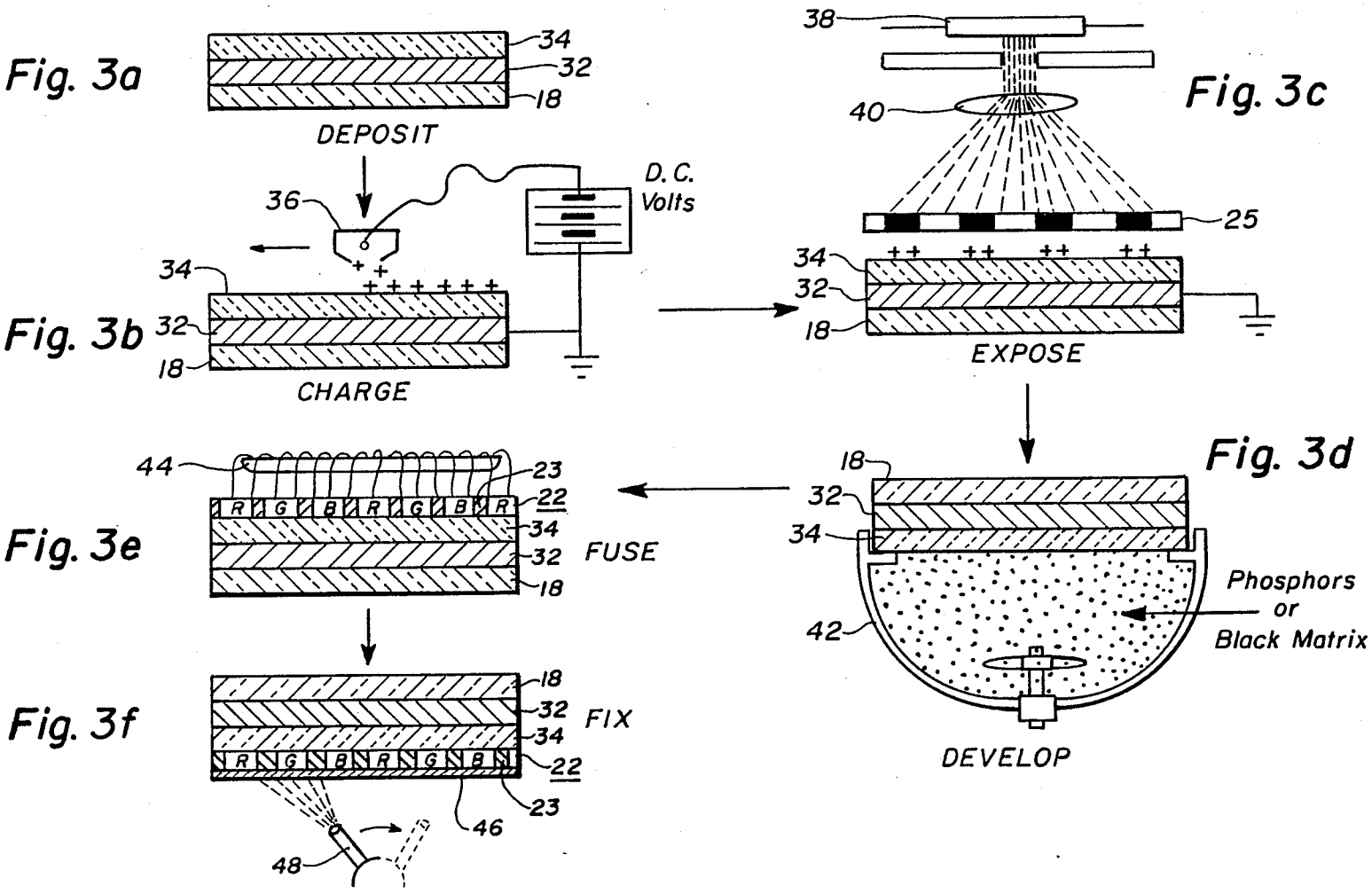

The screen structure materials, comprising the surface-treated matrix material and the surface-treated phosphor particles, are fused to the photoconductive layer 34 by contacting the photoconductive layer and the surface-treated materials with the vapors of a solvent, such as chlorobenzene, which are emitted from a container 44, shown in FIG. 3*e*, disposed, within an enclosure (not shown), above the faceplate 18. The heavy vapors soak and soften the underlying photoconductive layer and the polymeric coupling agent that coats the phosphor particles and the matrix material, and render the layer and the coatings tacky, to increase the adherence of the surface-treated screen structure materials to the photoconductive layer 34. By positioning the screen 22 of the faceplate upWardly, as shown in FIG. 3*e*, gravitational force is utilized to increase the adherence between the tacky surface-treated screen structure materials and the photoconductive layer. Vapor-soaking takes between 4 and 24 hours, and the panels are dried before further processing.

As shown in FIG. 3*f*, the faceplate 18 is then fixed in a series of steps to provide a fixing layer 46 overlying the screen 22 and the matrix 23. Repeated applications of the fixing layer are required to fully cover the granular screen structure materials so as to minimized the displacement thereof. In a first preferred embodiment of the invention, wherein the phosphor particles are coated with gelatin, the fixing mixture is formed by combining 0.1 weight percent of polyvinyl alcohol, PVA, with 25 percent water and 75 percent methyl or isopropyl alcohol. The mixture is sprayed onto the screen 22 from a spray nozzle 48 located about 61 to 122 centimeters from the screen. The spray time is between 2 and 5 minutes and the spray pressure is about 40 psi. These parameters provide a "dry" spray. A second coating of a 0.5 weight percent PVA and 50 percent water - 50 percent methyl or isopropyl alcohol is then sprayed for about 2 minutes followed by a third coating of a 1.0 weiqht percent PVA and 50 percent water - 50 percent alcohol mixture which is sprayed for an additional 2 minutes. Optionally, a fourth coating of an aqueous 1.0 weight percent PVA solution (no additional alcohol) is sprayed over the third coating when the subsequent processing steps include spray filming; however, the fourth coating is unnecessary if the subsequent processing steps include emulsion filming. The filmed screen is then aluminized and baked at a temperature of about 425° C. for 30 minutes to drive off the volatilizable organic constituents of the screen assembly.

In a second embodiment of the preferred invention, wherein the screen structure materials comprise a thermoplastic coating material the fixing can be accomplished in two steps. Initially, a 1.0 weight percent PVA and 50 percent water-50 percent alcohol (methyl or isopropyl) mixture is sprayed onto the screen 22 as described above. Then, an aqueous slurry of 0.5 weight percent PVA (no alcohol) is poured into the faceplate panel and dispersed, as is known in the art. The fixed panel is filmed by either the emulsion or spray method, both of which are known in the art, and then aluminized and baked as described above.

In each of the embodiments, the PVA includes 10 weight percent sodium dichromate or ammonium dichromate. Preferably, between each fixing step, the fixing layer 46 is flooded with light from a mercury arc lamp or a xenon lamp (not shown) to cross-link the polymers in the PVA thereby making the fixing layer water resistant. While dichromated PVA is the preferred material for the fixing layer 46, potassium silicate also may be used.

What is claimed is:

1. In a method of electrophotographically manufacturing a luminescent screen assembly on a substrate of a color CRT comprising the steps of:

(a) coating said surface of said substrate with a volatilizable conductive layer;

(b) overcoating said conductive layer with a volatilizable photoconductive layer including a dye sensitive to visible light;

(c) establishing a substantially uniform electrostatic charge on said photoconductive layer;

(d) exposing selected areas of said photoconductive layer to visible light to affect the charge thereon;

(e) developing selected areas of said photoconductive layer with a triboelectrically charged, dry-powdered, surface-treated first color-emitting phosphor;

sequentially repeating steps c, d and e for triboelectrically charged, dry-powdered, surface-treated second and third color-emitting phosphors to form a luminescent screen comprising picture elements of triads of color-emitting phosphors;

the improvement wherein the adherence of said dry-powdered, surface-treated phosphor materials to said photoconductive layer is increased by contacting said surface-treated phosphor materials and the underlying photoconductive layer with a solvent for a sufficient period to time to render said layer and said materials tacky, and fixing said surface-treated phosphor materials with at least one coating of a substantially dry spray of an aqueous alcohol mixture of a material selected from the group consisting of dichromated polyvinyl alcohol and potassium silicate to minimize the displacement of said phosphor materials.

2. The method of claim 1, wherein contacting comprises vapor-soaking said surface-treated phosphor materials and the underlying photoconductor layer in chlorobenzene.

3. The method of claim 1, including the additional steps of:

i filming said luminescent screen;

ii aluminizing said screen; and iii baking said screen to remove the volatilizable constituents therefrom to form said luminescent screen assembly.

4. The method of claim 1, wherein said fixing step includes providing a plurality of coatings to form a fixing layer.

5. The method of claim 4, further including the step of exposing each of said coatings to actinic radiation.

6. In a method of electrophotographically manufacturing a luminescent screen assembly on an interior surface of a faceplate panel for a color CRT comprising the steps of:

(a) coating said surface of said panel with a volatilizable conductive layer;

(b) overcoating said conductive layer with a volatilizable photoconductive layer including a dye sensitive to visible light;

(c) establishing a substantially uniform electrostatic charge on said photographic layer;

(d) exposing, through a mask, selected areas of said photoconductive layer to visible light from a xenon lamp to affect the charge on said photoconductive layer;

(e) directly developing the unexposed areas of the photoconductive layer with a triboelectrically charged, dry-powdered, surface-treated, light-absorptive screen structure material, the charge on said screen structure material being of opposite polarity to the charge on the unexposed areas of the photoconductive layer;

(f) reestablishing a substantially uniform electrostatic charge on said photoconductive layer and on said screen structure material;

(g) exposing, through said mask, first portions of said selected areas of said photoconductive layer to visible light from said lamp to affect the charge on said photoconductive layer;

(h) reversal developing the first portions of said selected areas of said photoconductive layer with a triboelectrically charged, dry-powdered, surface-treated, first color-emitting phosphor screen structure material having a charge of the same polarity as that on the unexposed areas of said photoconductive layer and on said light-absorptive screen structure material to repel said first color-emitting phosphor therefrom;

(i) sequentially repeating steps f, g and h for second and third portions of said selected areas of said photoconductive layer using triboelectrically charged, dry-powdered, surface-treated second and third color-emitting phosphor screen structure materials, thereby forming a luminescent screen comprising picture elements of triads of color-emitting phosphors;

wherein the improvement comprises increasing the adherence of said dry-powdered, surface-treated screen structure materials to said photoconductive layer by vapor-soaking said photoconductive layer and said surface-treated screen structure materials with chlorobenzene for a sufficient period of time to render said layer and said materials tacky, drying said luminescent screen, fixing said screen structure materials with at least one coating of a substantially dry spray of an aqueous alcohol mixture of a material selected from the group consisting of dichromated polyvinyl alcohol and potassium silicate to minimize the displacement of said screen structure materials;

filming said luminescent screen;

aluminizing said luminescent screen; and baking the luminescent screen to remove volatilizable constituents therefrom to form said luminescent screen assembly.

7. The method of claim 6, wherein said fixing step includes providing a slurry coating on said one coating to form a fixing layer.

8. The method of claim 6, wherein said fixing step includes providing a plurality of coatings of a substantially dry spray of said aqueous alcohol mixture of dichromated polyvinyl alcohol, wherein the concentration of said dichromated polyvinyl alcohol increases with each subsequent coating.

9. The method of claim 8, wherein said fixing step further includes providing a spray coating of aqueous dichromated polyvinyl alcohol as an overcoating to the prior applied coatings.

10. The method of claim 1, wherein said sufficient period of time is within the range of 4 to 24 hours.

11. The method of claim 6, wherein said sufficient period of time is within the range of 4 to 24 hours.

* * * * *

UNITED STATES PATENT AND TRADEMARK OFFICE
CERTIFICATE OF CORRECTION

PATENT NO. : 4,917,978

DATED : April 17, 1990

INVENTOR(S) : Peter M. Ritt and Harry R. Stork

It is certified that error appears in the above-identified patent and that said Letters Patent is hereby corrected as shown below:

Col. 4, line 32,
change ". (rom" to --, from--.

Col. 4, line 33,
after "positions" add --,--.

Col. 6, line 35,
change "upWardly" to --upwardly--.

Signed and Sealed this

Ninth Day of April, 1991

*Attest:*

HARRY F. MANBECK, JR.

*Attesting Officer*

*Commissioner of Patents and Trademarks*